US006354861B2

(12) United States Patent
Schmitt et al.

(10) Patent No.: US 6,354,861 B2
(45) **Date of Patent: *Mar. 12, 2002**

(54) DATA PROCESSING SYSTEM COMPONENT ALIGNMENT

(75) Inventors: Ty R. Schmitt, Round Rock; Vibora Sim, Pflugerville, both of TX (US)

(73) Assignee: Dell USA, L.P., Round Rock, TX (US)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/384,173

(22) Filed: Aug. 27, 1999

(51) Int. Cl.[7] ..... H01R 13/64
(52) U.S. Cl. ..... 439/376; 361/683
(58) Field of Search ..... 439/376; 361/683

(56) References Cited

U.S. PATENT DOCUMENTS

| | | | | | |
|---|---|---|---|---|---|
| 4,982,120 | A | | 1/1991 | Longwell et al. | 307/572 |
| 5,136,468 | A | * | 8/1992 | Wong et al. | 361/393 |
| 5,527,104 | A | | 6/1996 | Moss | 312/264 |
| 5,774,337 | A | * | 6/1998 | Lee et al. | 361/725 |
| 5,777,848 | A | | 7/1998 | McAnally et al. | 361/725 |
| 5,790,372 | A | | 8/1998 | Dewey et al. | 361/683 |
| 5,808,867 | A | * | 9/1998 | Wang | 361/695 |
| 5,822,184 | A | * | 10/1998 | Rabinovitz | 361/685 |
| 5,993,241 | A | * | 11/1999 | Olson et al. | 439/378 |
| 6,038,126 | A | * | 3/2000 | Weng | 361/679 |
| 6,108,198 | A | * | 8/2000 | Lin | 361/683 |
| 6,122,173 | A | * | 9/2000 | Felcman et al. | 361/726 |

OTHER PUBLICATIONS

Clifford A. Gibbons; "*Electronics Rack Alignment Structures*"; Oct 22, 1998; Serial No.: 09/177,649; 23 Pages of Specification; 8 Sheets of Drawings. (Copy Not Enclosed).

Andrew L. McAnally; R. Steven Mills; Eric Holloway; "*Computer Power Supply Insertion And Extraction Apparatus And Method*"; Oct. 24, 1997; Serial No.: 08/957,433; 17 Pages of Specification. (Copy Not Enclosed).

David Hernandez; Robert D. Hrehor, Jr.; Gilberto Hernandez; "*Method And Apparatus For Articulating A Power Supply In A Computer System*"; Mar. 25, 1999; Serial No.: 09/276,626. (Copy Not Enclosed).

* cited by examiner

*Primary Examiner*—Brian Sircus
*Assistant Examiner*—Hae Moon Hyeon
(74) *Attorney, Agent, or Firm*—Skjerven Morrill MacPherson, LLP; Stephen A. Terrile

(57) ABSTRACT

A method and apparatus related to a data processing system contiguous-reference connection alignment mechanism. In one embodiment, an apparatus includes but is not limited to a data processing system contiguous-reference connection alignment mechanism, wherein the data processing system contiguous-reference connection alignment mechanism further includes but is not limited to a y-axis direction contiguous-reference alignment mechanism, wherein the y-axis direction contiguous-reference alignment mechanism further includes but is not limited to at least one fore-positioned data processing system connection guidance cylinder slot formed to catch a connection guidance cylinder misaligned in the y-axis direction and guide the connection guidance cylinder into substantial y-axis direction alignment. In one embodiment, a computer system includes but is not limited to a data processing system contiguous-reference alignment mechanism.

40 Claims, 10 Drawing Sheets

DATA PROCESSING SYSTEM COMPONENT ALIGNMENT

BACKGROUND OF THE INVENTION

1. Field of the Invention

The present invention relates, in general, to a method and system to be utilized in data processing systems.

2. Description of the Related Art

Data processing systems are systems that manipulate, process, and store data and are notorious within the art. Personal computer systems, and their associated subsystems, constitute one well known species of data processing systems. Network server computer systems, and their associated subsystems, constitute another well known species of data processing systems.

A personal computer system may be a desktop model system which can include one or more of the following: microprocessors, fans, magnetic disk drives, CD-ROM disk drives, keyboards, printer devices, monitors, modems, digital cameras, fax machines, network cards, and various associated data buses to support the foregoing noted devices, as well as the supporting software to allow the foregoing devices to work together to provide a complete standalone system; furthermore, various other devices can also be utilized in order to provide the complete standalone system.

A network server computer system (which may be a rack mount, tower mount, or other type mount system) can include some or all of the foregoing noted components listed for the desktop model system, plus other additional hardware or software, such as hardware or software necessary to control one or more network switches. Network server computers typically serve as vital components for bridging and routing across data networks. From a network topology standpoint, network server computers typically serve as a network "node" or point of connection between two or more data links. Consequently, if a network server computer goes "down" or "off-line," at least part of the data communications network of which the network server computer is a part becomes temporarily unavailable for data communications.

In order to ensure that network server computers remain on line as much as possible, the industry has been migrating toward what are known in the art as redundant hot-swappable power supplies. That is, the servers typically have more than one power supply so that in case a primary power supply fails, a secondary power supply can take over. Furthermore, the power supplies are "hot swappable" so that the server doesn't have to be powered down to swap out the power supplies.

Insofar as the power supplies are to be redundant so that a secondary power supply can continue to supply a network server computer if the primary power supply goes down, it is important that the power supplies be correctly connected. Those skilled in the art will recognize that network server power supplies typically have connectors which contain several sub-connectors (e.g., a pin-type connector, or a board-edge connector), where each sub-connector must be properly aligned and connected so that all essential components of the network server computer continue to function. If any of the sub-connectors are improperly connected, the network server computer is in jeopardy.

Those skilled in the art will recognize that current methods of aligning and connecting redundant hot-swappable power supplies typically rely solely on the chassis housing of the network server computer systems to grossly align the redundant hot-swappable power supply board connectors.

Variations in chassis manufacture often result in power-supply connections being skewed, or poorly aligned, which can result in no connections or poor connections among some or all of the aforementioned sub-connectors. In addition, there are times when the misalignment is so great that the connectors are actually damaged when a user is attempting to insert a power supply. This method of gross alignment is sub-optimum, and can actually frustrate the purpose for which the redundant hot-swappable power supplies were conceived and designed, in that it gives rise to a likelihood that the swappable power supplies will not function correctly.

Those skilled in the art will recognize that the foregoing noted problems are merely illustrative of connection alignment problems that exist across a number of data processing system components. For example, similar problems exist with respect to aligning the connections of hard drives deployed in hard drive sleds, and aligning the connections of CD-ROM drives when the CD-ROM devices are deployed in CD-ROM sleds.

It is therefore apparent that a need exists in the art for a method and apparatus which will provide precise and accurate alignment of data processing component connections, such as the connections of power supplies deployed in a redundant hot-swappable power supply environment.

SUMMARY OF THE INVENTION

It has been discovered that a method and apparatus can be produced which will provide precise and accurate alignment of data processing component connections, such as the connections of power supplies deployed in a redundant hot-swappable power supply environment.

In one embodiment, an apparatus includes but is not limited to a data processing system contiguous-reference connection alignment mechanism, wherein the data processing system contiguous-reference connection alignment mechanism further includes but is not limited to a y-axis direction contiguous-reference alignment mechanism, wherein the y-axis direction contiguous-reference alignment mechanism further includes but is not limited to at least one fore-positioned data processing system connection guidance cylinder slot formed to catch a connection guidance cylinder misaligned in the y-axis direction and guide the connection guidance cylinder into substantial y-axis direction alignment.

In one embodiment, the data processing system contiguous-reference connection alignment mechanism further includes but is not limited to a hard drive connection. In one embodiment, the data processing system contiguous-reference connection alignment mechanism further includes but is not limited to a CD-ROM connection.

In one embodiment, a computer system having a data processing system contiguous-reference connection alignment mechanism includes but is not limited to: the data processing system contiguous-reference connection alignment mechanism, wherein the data processing system contiguous-reference connection alignment mechanism further includes but is not limited to: a y-axis direction contiguous-reference alignment mechanism, wherein the y-axis direction contiguous-reference alignment mechanism further includes but is not limited to: (i) at least one fore-positioned data processing system connection guidance cylinder slot formed to catch a connection guidance cylinder misaligned in the y-axis direction and guide the connection guidance cylinder into substantial y-axis direction alignment; (ii) a data processing system component; (iii) an operating system; a processing unit; and (iv) a system memory.

In one embodiment, the computer system further includes but is not limited to a data processing system contiguous-reference connection alignment mechanism which includes but is not limited to a hard drive connection. In one embodiment, the computer system further includes a data processing system contiguous-reference connection alignment mechanism which includes but is not limited to a CD-ROM connection.

In one embodiment, a method of aligning a data processing system connection relative to a contiguous-reference structure includes but is not limited to aligning a data processing system connection relative to a contiguous-reference structure, wherein the aligning a data processing system connection relative to a contiguous-reference structure further includes but is not limited to aligning the data processing system connection in a y-axis direction relative to the contiguous-reference structure, wherein the aligning the data processing system connection in a y-axis direction relative to the contiguous-reference structure further includes but is not limited to aligning the data processing system connection via at least one fore-positioned data processing system connection guidance cylinder slot formed to catch a connection guidance cylinder misaligned in the y-axis direction and guide the connection guidance cylinder into substantial y-axis direction alignment.

In one embodiment, the aligning a data processing system connection relative to a contiguous-reference structure further includes but is not limited to aligning a hard drive connection.

In one embodiment, the aligning a data processing system connection relative to a contiguous-reference structure further includes but is not limited to aligning a CD-ROM connection.

The foregoing is a summary and thus contains, by necessity, simplifications, generalizations and omissions of detail; consequently, those skilled in the art will appreciate that the summary is illustrative only and is not intended to be in any way limiting. Other aspects, inventive features, and advantages of the present invention, as defined solely by the claims, will become apparent in the non-limiting detailed description set forth below.

BRIEF DESCRIPTION OF THE DRAWINGS

The present invention may be better understood, and its numerous objects, features, and advantages made apparent to those skilled in the art by referencing the accompanying drawings.

The use of the same reference symbols in different drawings indicates similar or identical items.

DESCRIPTION OF THE PREFERRED EMBODIMENT(S)

The following sets forth a detailed description of the best contemplated mode for carrying out the independent invention(s) described herein. The description is intended to be illustrative and should not be taken to be limiting.

Figure 1:
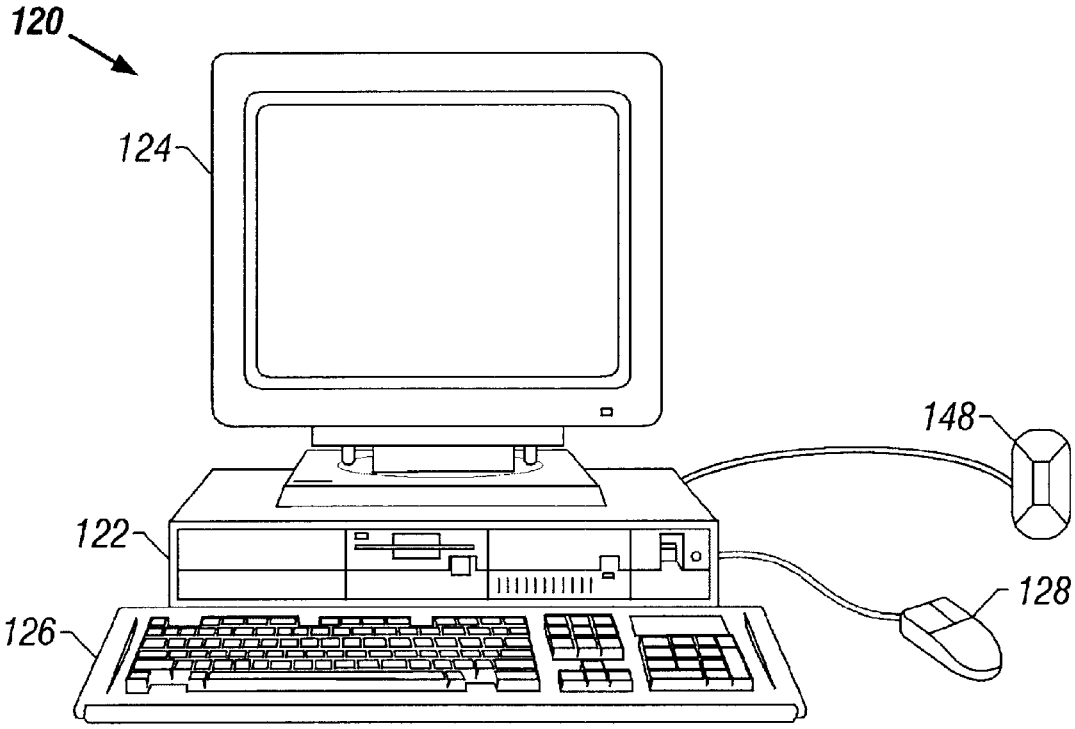
FIG. 1 depicts a pictorial representation of a data-processing system in which power supplies are deployed.

With reference now to the figures and in particular with reference now to FIG. 1, there is depicted a pictorial representation of a data-processing system in which power supplies (not shown) are deployed. A network server computer 120 is depicted. Shown present and associated with network server computer 120 are system unit 122, video display device 124, keyboard 126, mouse 128, and microphone 148. Network computer system 120 may be implemented utilizing any suitable network server computer such as the Dell PowerEdge©™ network server computer. Those skilled in the art will recognize that various implementations of network server computer 120 can have many different components, such as those components illustrated below in FIG. 2 and FIG. 3.

Figure 2:
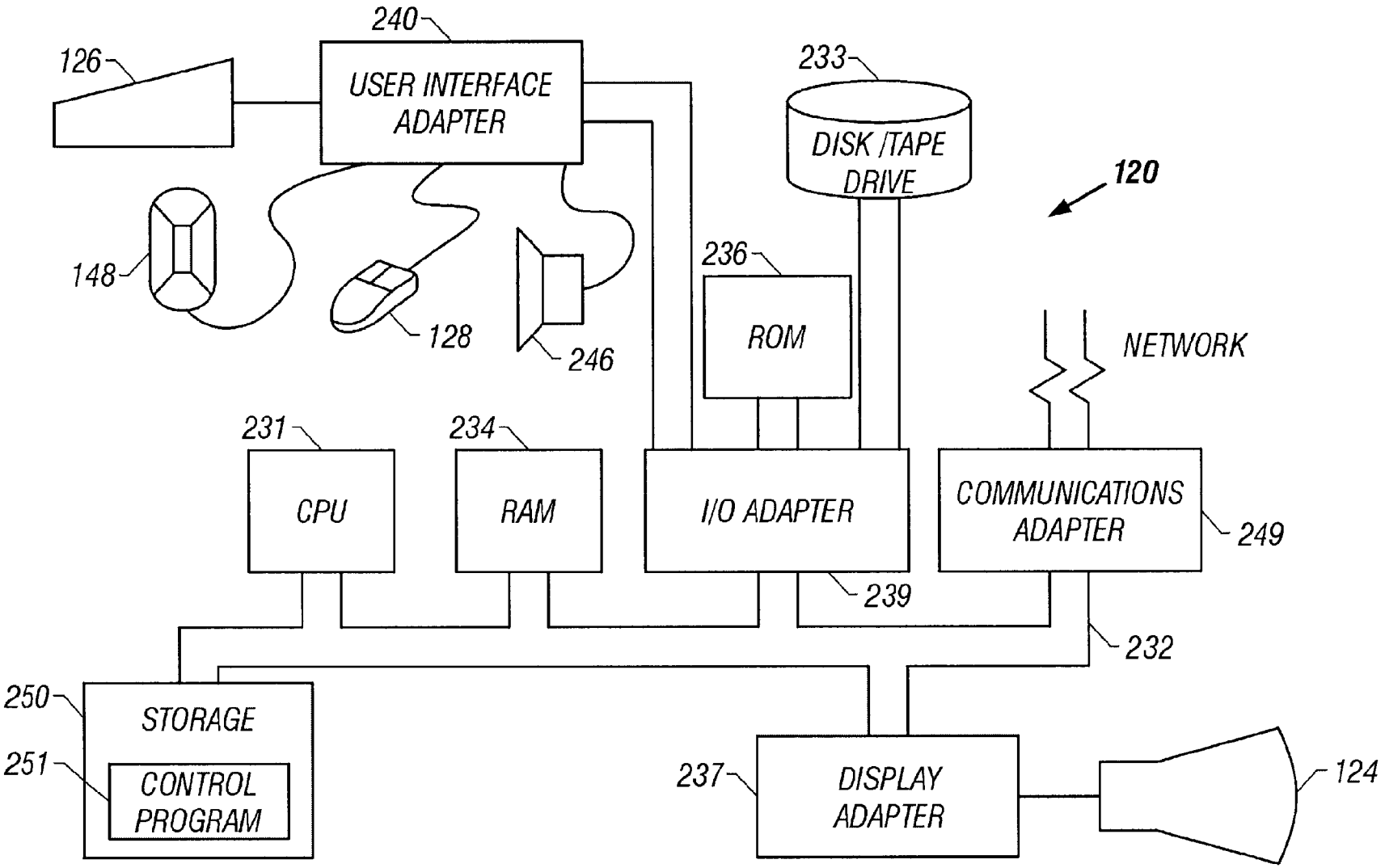
FIG. 2 illustrates selected components which may be present within an implementation of network server computer 120.

Referring now to FIG. 2, illustrated are selected components which may be present within an implementation of network server computer 120. Network server computer 120 includes a Central Processing Unit ("CPU") 231, which is intended to be representative of either a conventional microprocessor, or more modem multiprocessors, and a number of other units interconnected via system bus 232. Network server computer 120 includes random-access memory ("RAM") 234, read-only memory ("ROM") 236, display adapter 237 for connecting system bus 232 to video display device 124, and I/O adapter 239 for connecting peripheral devices (e.g., disk and tape drives 233) to system bus 232. Video display device 124 is the visual output of computer 120, which can be a CRT-based video display well-known in the art of computer hardware. However, video display device 124 can also be an LCD-based or a gas plasma-based flat-panel display. Network server computer 120 further includes user interface adapter 240 for connecting keyboard 126, mouse 128, speaker 246, microphone 148, digital camera and/or other user interface devices (not shown), such as a touch screen device (not shown), to system bus 232 through I/O adapter 239. Communications adapter 249 connects network server computer 120 to a data-processing network.

Any suitable machine-readable media may retain the graphical user interface, such as RAM 234, ROM 236, a magnetic diskette, magnetic tape, or optical disk (the last three being located in disk and tape drives 233). Any suitable operating system and/or associated graphical user interface (e.g., Microsoft Windows©™) may direct CPU 231. Other technologies can also be utilized in conjunction with CPU 231, such as touch-screen technology or human voice control. In addition, network server computer 120 includes a control program 251 which resides within computer storage 250.

Those skilled in the art will appreciate that the hardware depicted in FIG. 2 may vary for specific applications. For example, other peripheral devices such as optical disk media, audio adapters, or programmable devices, such as PAL or EPROM programming devices well-known in the art of computer hardware, and the like may be utilized in addition to or in place of the hardware already depicted.

Those skilled in the art will recognize that network server computer 120 can be described in relation to other network server computers which perform essentially the same functionalities, irrespective of architectures.

Figure 3:
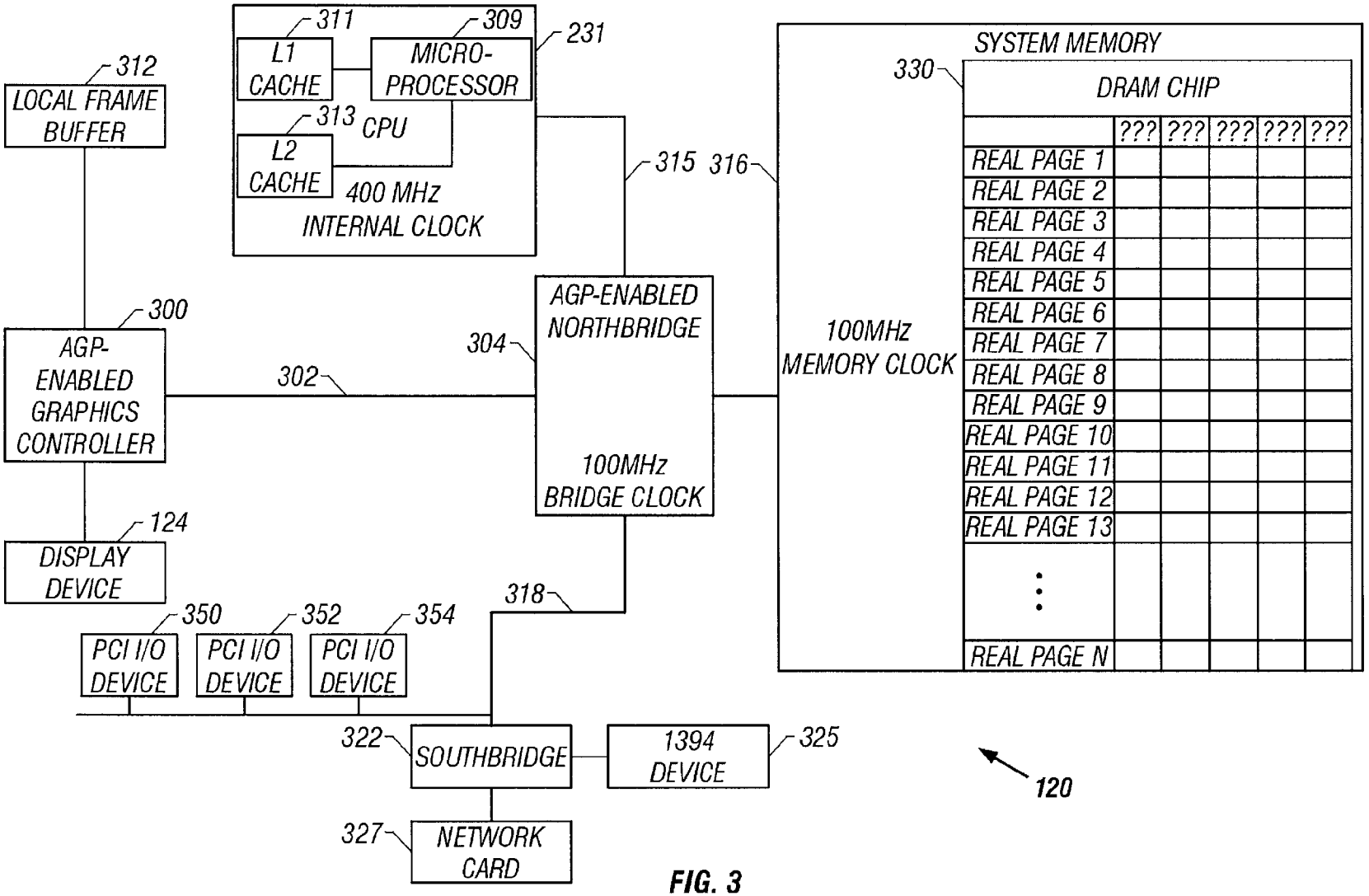
FIG. 3 illustrates selected components which may be present within an implementation of network server computer 120.

Referring now to FIG. 3, illustrated are selected components which may be present within an implementation of network server computer 120. Shown are AGP-enabled graphics controller 300, AGP interconnect 302 (a data bus), and AGP-enabled Northbridge©™ 304. Not shown, but deemed present is an AGP-enabled operating system. The term AGP-enabled is intended to mean that the so-referenced components are engineered such that they interface and function under the standards defined within the AGP interface specification (Intel Corporation, Accelerated Graphics Port Interface Specification, Revision 1.0 (Jul. 31, 1996)). Further depicted are video display device 124, local frame buffer 312, Central Processing Unit (CPU) 231 (wherein are depicted microprocessor 309, L1 Cache 311, and L2 Cache 313), CPU bus 315, system memory 316, Peripheral Component Interconnect (PCI) bus 318, various PCI Input-Output (I/O) devices 350, 352, and 354, Southbridge 322, 1394 Device 325, and network card 327.

The foregoing components and devices are used herein as examples for sake of conceptual clarity. As for (non-exclusive) example, CPU 231 is utilized as an exemplar of any general processing unit, including but not limited to multiprocessor units; CPU bus 315 is utilized as an exemplar of any processing bus, including but not limited to multiprocessor buses; PCI devices 350–354 attached to PCI bus 318 are utilized as an exemplar of any input-output devices attached to any I/O bus; AGP Interconnect 302 is utilized as an exemplar of any graphics bus; AGP-enabled graphics controller 300 is utilized as an exemplar of any graphics controller; Northbridge 304 and Southbridge 322 are utilized as exemplars of any type of bridge; 1394 device 325 is utilized as an exemplar of any type of isochronous source; and network card 327, even though the term "network" is used, is intended to serve as an exemplar of any type of synchronous or asynchronous input-output cards. Consequently, as used herein these specific exemplars are intended to be representative of their more general classes. Furthermore, in general, use of any specific exemplar herein is also intended to be representative of its class and the non-inclusion of such specific devices in the foregoing list should not be taken as indicating that limitation is desired.

Generally, each bus utilizes an independent set of protocols (or rules) to conduct data (e.g., the PCI local bus specification and the AGP interface specification). These protocols are designed into a bus directly and such protocols are commonly referred to as the "architecture" of the bus. In a data transfer between different bus architectures, data being transferred from the first bus architecture may not be in a form that is usable or intelligible by the receiving second bus architecture. Accordingly, communication problems may occur when data must be transferred between different types of buses, such as transferring data from a PCI device on a PCI bus to a CPU on a CPU bus. Thus, a mechanism is developed for "translating" data that are required to be transferred from one bus architecture to another. This translation mechanism is normally contained in a hardware device in the form of a bus-to-bus bridge (or interface) through which the two different types of buses are connected. This is one of the functions of AGP-enabled Northbridge 304, Southbridge 322, and other bridges shown in that it is to be understood that such can translate and coordinate between various data buses and/or devices which communicate through the bridges.

Figure 4:
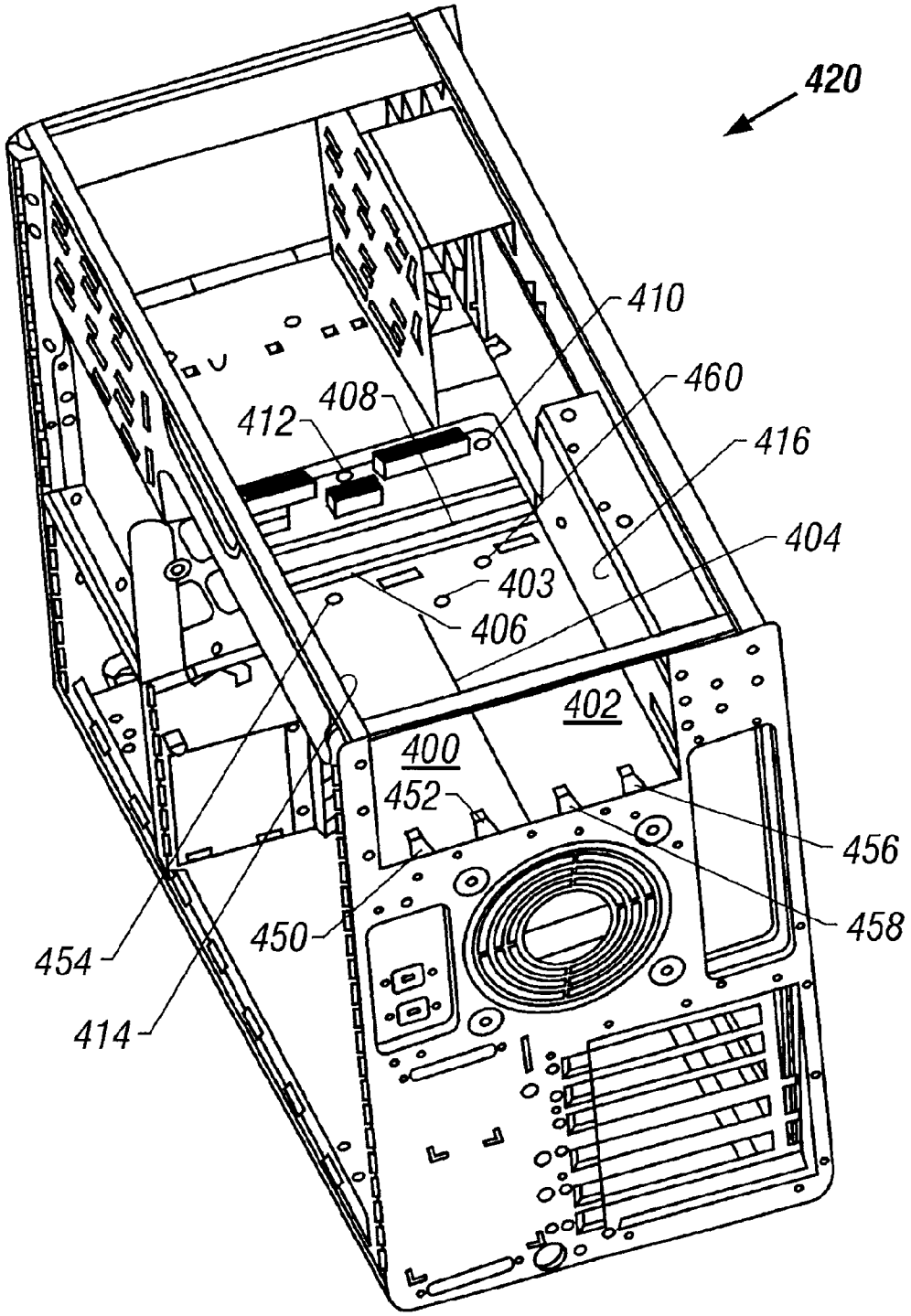
FIG. 4 shows a perspective cut-away view of the back of network server computer chassis 420, which is the metal framework that holds and supports the components of network server computer 120.

Referring now to FIG. 4, shown is a perspective cut-away view of the back of network server computer chassis 420, which is the metal framework that holds and supports the components of network server computer 120. Depicted are power supply receptacle floors 400, 402, formed on base plate 403 (base plate 403 is formed from one continuous piece of material (e.g., metal or plastic or ceramic) and thus serves as an example of a contiguous-reference from which data processing system component connections can be finely and accurately aligned in a manner described below), and separated from each other by power supply separation border 404 (power supply separation border 404 is shown for illustration purposes, but in one embodiment does not physically separate power supplies from each other). Illustrated is that power supply receptacle floors 400, 402 are empty. Depicted are power supply board connectors 406, 408 which are affixed to base plate 403 from which power supply base receptacle floors 400, 402 are formed. Illustrated are power supply board connectors 406, 408 affixed to base plate 403 via hooks 410 (which are formed from base plate 403) and thumbscrew 412 which screws into a stud (not shown) which is pressed fit into the base plate 403. Also illustrated are power supply receptacle sides 414, 416.

Shown cut into power supply receptacle floor 400 are aft-positioned power supply guidance slots 450, 452, and shown pressed fit into power supply receptacle floor 400 is fore-positioned power supply guidance cylinder 454. Shown cut into power supply receptacle floor 402 are aft-positioned power supply guidance slots 456, 458 and shown pressed fit into power supply receptacle floor 402 is fore-positioned power supply guidance cylinder 460. The guidance slots and cylinders are utilized to provide fine alignment of power supply boards and power supply board connectors in a fashion set forth below.

Figure 5:
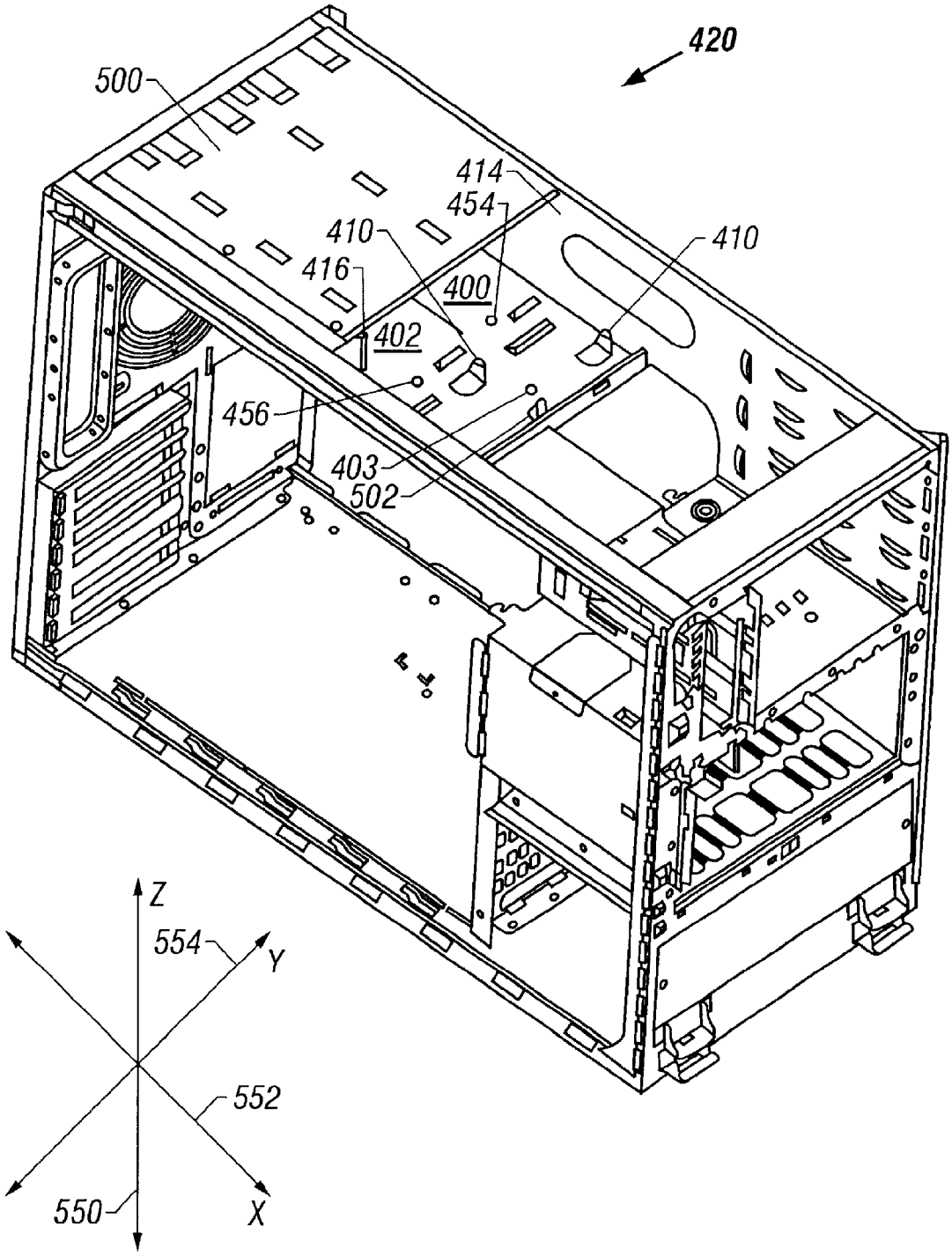
FIG. 5 shows a perspective cut-away view of the front of network server computer chassis 420, which is the metal framework that holds and supports the components of network server computer 120.

With reference now to FIG. 5, shown is a perspective cut-away view of the front of network server computer chassis 420, which is the metal framework that holds and supports the components of network server computer 120. The view of FIG. 4 shows network server computer chassis 420 without a top cover. In contrast, the view of FIG. 5 shows top cover 500, which serves as a roof of a first and a second power supply receptacle formed by power supply receptacle floors 400, 402 and power supply receptacle sides 414, 416. The first power supply receptacle is depicted as formed by top cover 500, power supply receptacle floor 400, and power supply receptacle side 414. The second power supply receptacle is illustrated as formed by top cover 500, power supply receptacle floor 402, and power supply receptacle side 416.

Shown in detail are hooks 410, which are shown formed from base plate 403, and stud 502 which is also shown pressed fit into base plate 403. As noted above in relation to FIG. 4, hooks 410 and thumbscrew 412 hold power supply board connectors 406, 408 affixed to base plate 403. A significant benefit which arises from the fact that hooks 410 and stud 502 are respectively formed from and pressed fit into base plate 403 is that their tolerances can be closely controlled relative to the portions of base plate 403 which form power supply receptacle floors 400, 402. Thus, since power supply board connectors (e.g., 406, 408 in FIG. 4) are affixed to base plate 403 via hooks 410 and stud 502, the positioning (both vertical positioning along z-axis 550, and horizontal positioning along x and y axes 552, 554) of power supply board connectors 406, 408 can also be closely controlled relative to base plate 403. As will be discussed below, power supplies (not shown) which sit upon power supply receptacle floors 400, 402 formed from base plate 403, contain mating power supply connectors (not shown) which mate with power supply board connectors 406, 408, which will allow the vertical positioning of the mating power supply connectors (not shown) to be closely controlled relative to base plate 403. Accordingly, since the positioning of power supply board connectors 406, 408 and mating power supply connectors (not shown) may both be closely controlled relative to base plate 403, the positioning of power supply board connectors 406, 408 and mating power supply connectors (not shown) can individually be precisely controlled such that power supply connections between power supply board connectors 406, 408 and mating power supply connectors (not shown) can be correctly and finely aligned in the vertical direction along the z-axis 550.

As has been discussed, the vertical positioning of power supply connections along z-axis 550 can be tightly controlled by the fact that power supply board connectors 406, 408 and mating power supply connectors (not shown) can be tightly controlled along z-axis 550 by the foregoing mechanism. However, while the foregoing in and of itself proves very useful, additional benefits can also be derived by providing alignment in the horizontal plane (i.e., along the x-axis 552 and y-axis 554).

Figure 6:
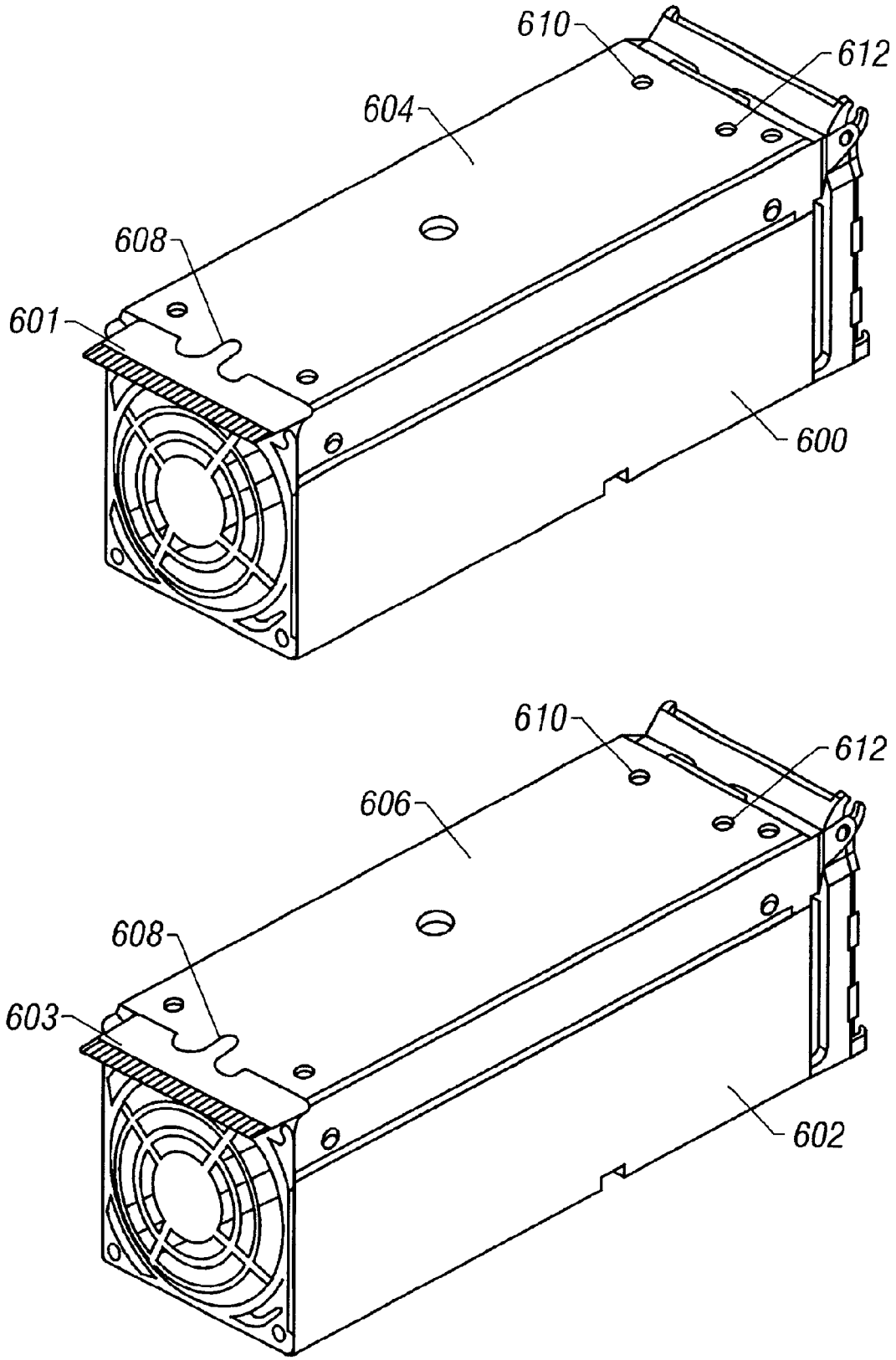
FIG. 6 shows power supplies 600, 602 to be respectively inserted into a first power supply receptacle depicted as formed by top cover 500, power supply receptacle floor 400, and power supply receptacle side 414, and a second power supply receptacle formed by top cover 500, power supply receptacle floor 402, and power supply receptacle side 416.

Referring now to FIG. 6, shown are power supplies 600, 602 to be respectively inserted into a first power supply receptacle depicted as formed by top cover 500, power supply receptacle floor 400, and power supply receptacle side 414, and a second power supply receptacle formed by top cover 500, power supply receptacle floor 402, and power supply receptacle side 416. Note that power supplies 600, 602 are substantially identical to each other.

Power supplies 600, 602 are depicted upside down. With respect to power supply 600, illustrated is bottom 604 which is to sit upon and/or interface with power supply receptacle floor 400. Shown is that power supply bottom 604 has a fore-positioned power supply guidance cylinder slot 608 and two aft-positioned power supply guidance cylinders 610, 612. Fore-positioned power supply guidance cylinder slot 608 is stamped such that it receives and holds snugly power supply guidance cylinder 454. The diameters of the two aft-positioned power supply guidance cylinders 610, 612 are such that they mate with and are held snugly within aft-positioned power supply guidance slots 450, 452. With respect to power supply 602, illustrated is bottom 606 which is to sit upon and/or interface with power supply receptacle floor 402. Shown is that power supply bottom 606 has a fore-positioned power supply guidance cylinder slot 608 and two aft-positioned power supply guidance cylinders 610, 612. Fore-positioned power supply guidance cylinder slot 608 is stamped such that it receives and holds snugly power supply guidance cylinder 460. The diameters of the two aft-positioned power supply guidance cylinders 610, 612 are such that they mate with and are held snugly within aft-positioned power supply guidance slots 456, 458. The guidance slots and cylinders are utilized to provide fine alignment of power supplies 600, 602 and their respective mating power supply connectors 601, 603 in the x-axis 552 and y-axis 554 directions.

Figure 7A:
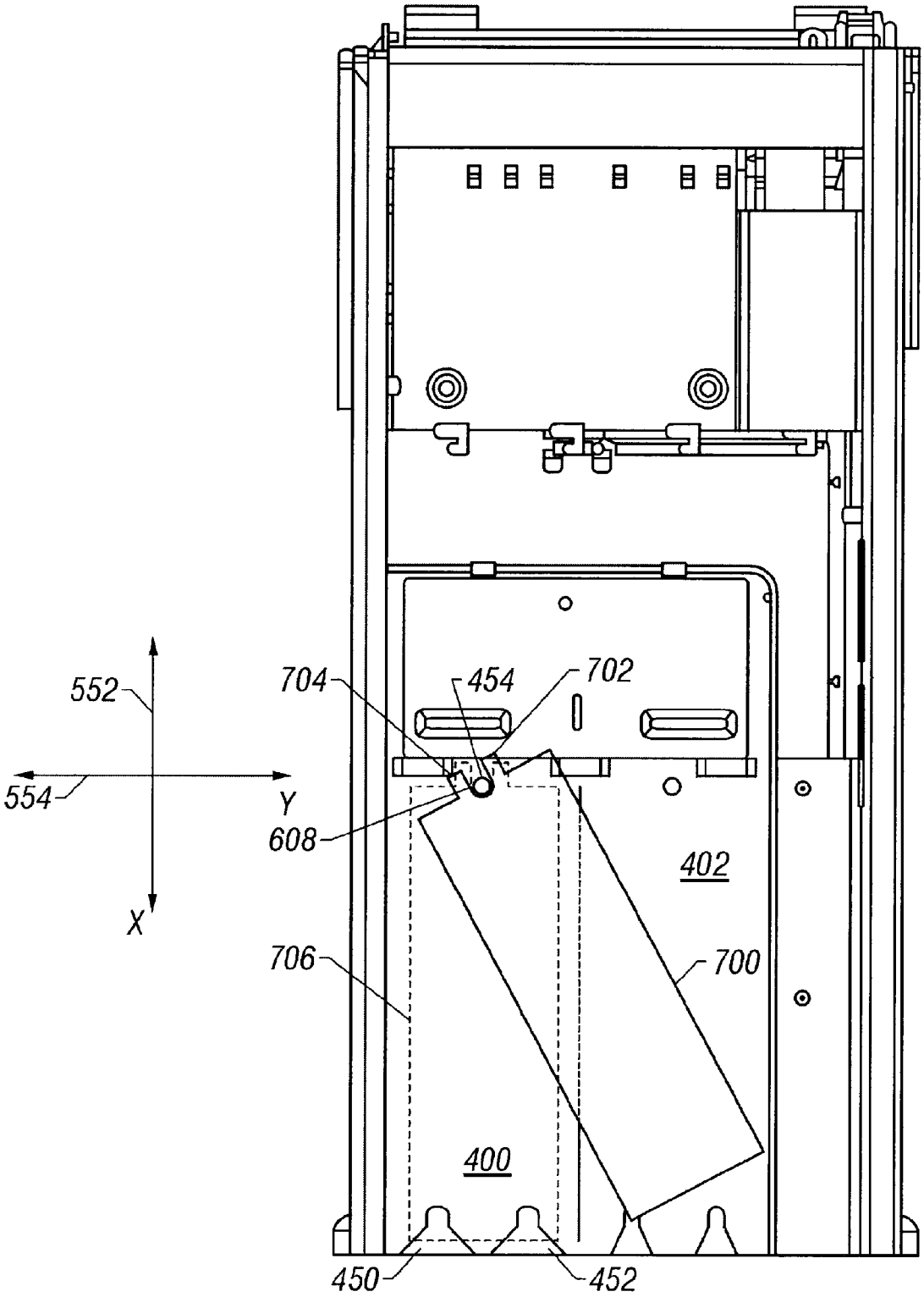
FIG. 7A shows a plan view (looking down on network server computer chassis 420 from some point along z-axis 550) of power supply receptacle floors 400, 402 which shows that power supply guidance cylinder 454 can be utilized to roughly align power supply 600 (and hence mating connector 601 of power supply 600) along x-axis 552 and y-axis 554 but that such alignment can still be slightly skewed.

Referring now to FIG. 7A, shown is a plan view (looking down on network server computer chassis 420 from some point along z-axis 550) of power supply receptacle floors 400, 402. Viewed from this perspective, it can be seen that power supply guidance cylinder 454 can be utilized to roughly align power supply 600 (and hence mating connector 601 of power supply 600) along x-axis 552 and y-axis 554. To illustrate this, shown is a portion 700 of bottom 604 (referred to as portion 700 since bottom 604 is depicted without two aft-positioned power supply guidance cylinders 610, 612) having fore-positioned power supply guidance cylinder slot 608 engaged upon fore-positioned power supply guidance cylinder 454. Depicted is that while fore-positioned power supply guidance slot 608 roughly aligns itself correctly in the x-axis 552 and y-axis 554 directions, it is still possible for power supply guidance cylinder slot 608 to skew (i.e., rotate about power supply guidance cylinder 454) slightly such that it its leading edges 702, 704 are not correctly positioned and aligned in the x-axis 552 and y-axis 554 directions. For sake of illustration, fore-positioned power supply guidance slot 608 is shown grossly skewed (illustrated in the context of desired position 706), but it is to be understood that in practice the skewing will be less than that shown, especially in the situation where a power supply or other structure is deployed within or upon power supply receptacle floor 402, in which case fore-positioned power supply guidance slot 608 in and of itself can provide serviceable and useable alignment of power supply 600 (and hence mating power supply connector 601 of power supply 600).

Figure 7B:
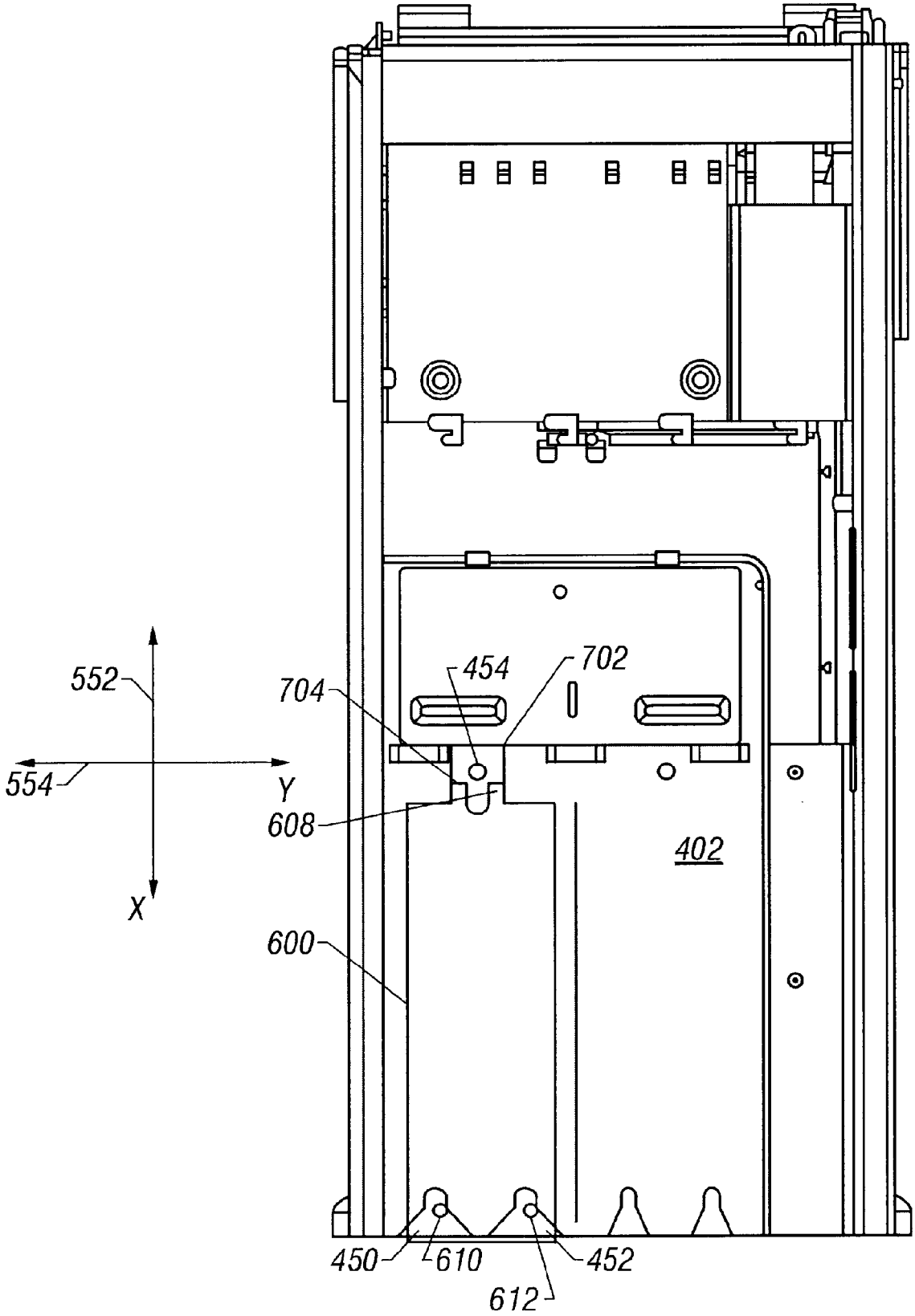
FIGS. 7B and 7C show a plan view (looking down on network server computer chassis 420 from some point along z-axis 550) of power supply receptacle floors 400, 402 wherein it is shown that the "skewing" problem, described in relation to FIG. 7A, is remedied via two aft-positioned power supply guidance cylinders 610, 612 interacting with aft-positioned power supply guidance slots 450, 452.
Figure 7C:
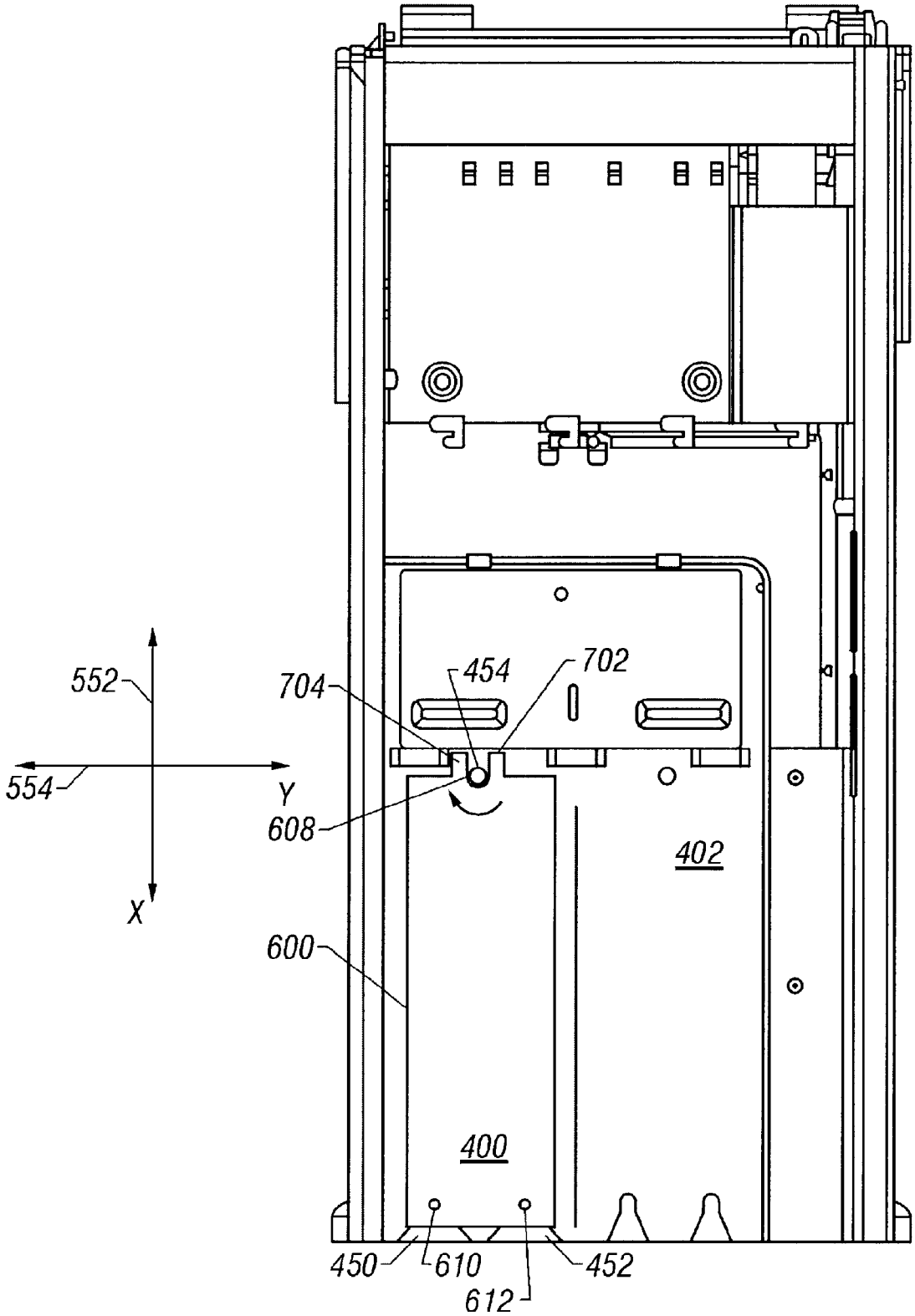

With reference now to FIG. 7B and 7C, shown is a plan view (looking down on network server computer chassis 420 from some point along z-axis 550) of power supply receptacle floors 400, 402 wherein it is shown that the "skewing" problem, described in relation to FIG. 7A, is remedied via two aft-positioned power supply guidance cylinders 610, 612 (described in relation to FIG. 6) interacting with aft-positioned power supply guidance slots 450, 452. Referring now to FIG. 7B, viewed from this perspective, it can be seen that two aft-positioned power supply guidance cylinders 610, 612 interacting with aft-positioned power supply guidance slots 450, 452 can be utilized to properly align bottom 604 of power supply 600 (and hence mating connector 601 of power supply 600) along x-axis 552 and y-axis 554. (For sake of illustration, power supply 600, and bottom 604 of power supply 600, are depicted transparently so that the interaction between the guidance slots and guidance cylinders can be observed). To illustrate this, shown is a fore-positioned power supply guidance cylinder slot 608 partially engaged upon fore-positioned power supply guidance cylinder 454 in a partially skewed fashion. Depicted is that two aft-positioned power supply guidance cylinders 610, 612 are about to impinge upon aft-positioned power supply guidance slots 450, 452.

Referring now to FIG. 7C, depicted is that bottom 604 of power supply 600 has been moved in the x-axis 552 direction such that all cylinders and slots are fully engaged. In particular, shown is that two aft-positioned power supply guidance cylinders 610, 612 are firmly seated with aft-positioned power supply guidance slots 450, 452. As shown, two aft-positioned power supply guidance cylinders 610, 612 and aft-positioned power supply guidance slots 450, 452 are such that when two aft-positioned power supply guidance cylinders 610, 612 are firmly seated with aft-positioned power supply guidance slots 450, 452 of fore-positioned power supply guidance cylinder slot 608 engaged upon fore-positioned power supply guidance cylinder 454 is correctly oriented in the x-axis 552 and y-axis 554 directions. Consequently, since fore-positioned power supply guidance cylinder slot 608 is affixed to bottom 604 of power supply 600, and since mating connector 601 of power supply 600 is affixed to and moves with power supply 600, two aft-positioned power supply guidance cylinders 610, 612 interacting with aft-positioned power supply guidance slots 450, 452 solve the "skewing" problem noted above.

While the foregoing discussion has described the alignment of structures related to power supply 600 and power supply receptacle floor 400, those skilled in the art will recognize that the foregoing discussion extends to the alignment of structures related to power supply 602 and power supply receptacle floor 402 by analogy.

Figure 8:
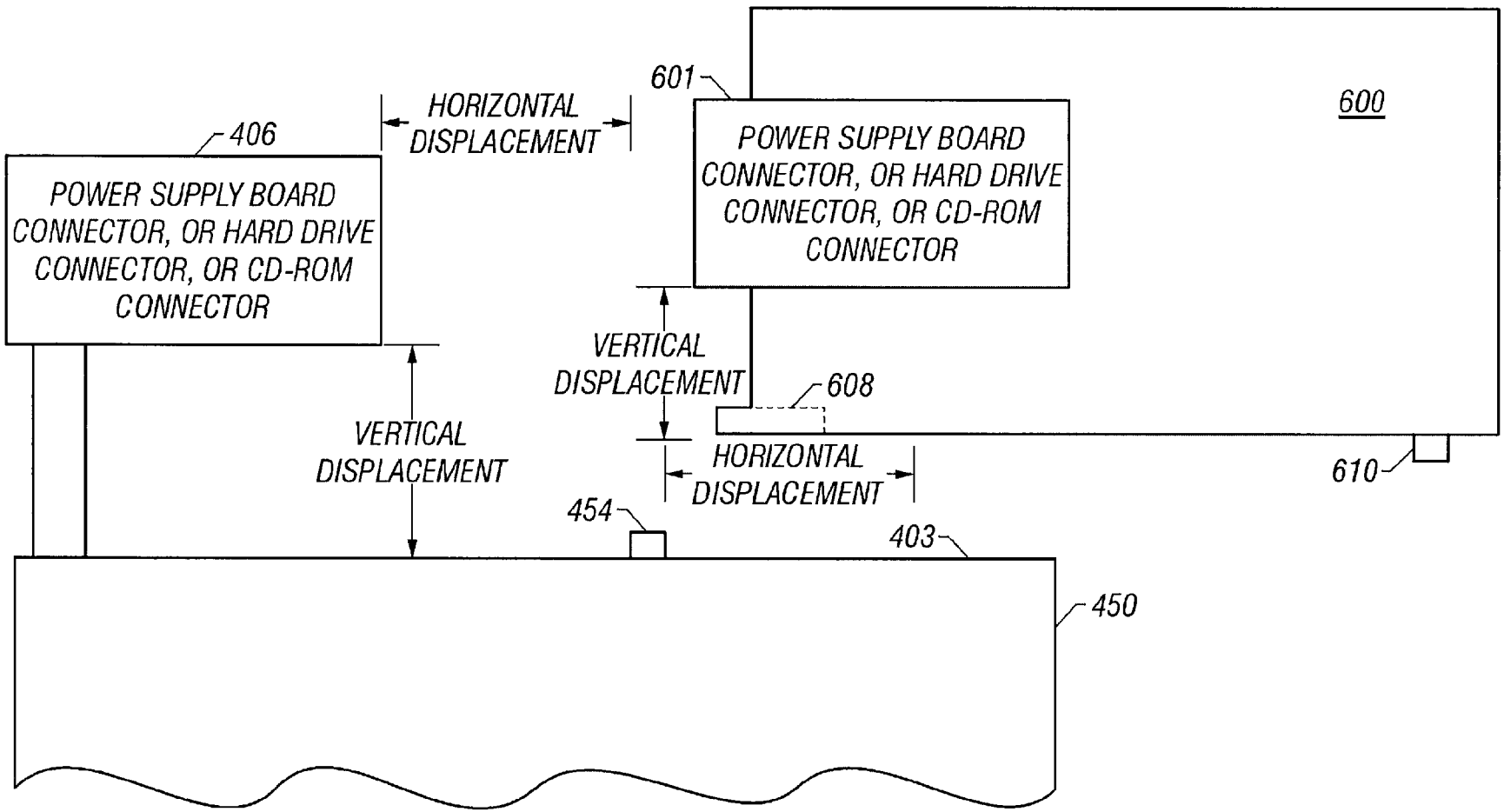
FIG. 8 shows a side-plan view of various implementations of devices shown in the figures (e.g., FIGS. 4, 5, and 6) wherein composite power supply, hard drive, or CD-ROM connections are depicted as effected by connectors positioned vertically and horizontally relative to structures.

With reference now to FIG. 8, shown is a side-plan view of various implementations of devices shown in the figures (e.g., FIGS. 4, 5, and 6) wherein composite power supply, hard drive, or CD-ROM connections are depicted as effected by connectors positioned vertically and horizontally relative to structures.

Other Embodiments

Several various embodiments have been described above, and it will be obvious to those skilled in the art that, based upon the teachings herein, changes and modifications may be made without departing from this invention and its broader aspects. That is, all examples set forth herein are intended to be exemplary and non-limiting.

For example, while the foregoing described embodiments have been described in the context of a single processor for the sake of clarity, it will be understood by those within the art that the present invention could be used in multiple processor environments. Furthermore, while two aft-positioned alignment slots were described above, those skilled in the art will also recognize the one aft-positioned alignment slot could also be utilized to align the power supply/power supply mating connector in the x-axis direction, as described above. Accordingly, the described architectures are not intended to be limiting.

Other embodiments are within the following claims.

While particular embodiments of the present invention have been shown and described, it will be obvious to those skilled in the art that, based upon the teachings herein, changes and modifications may be made without departing from this invention and its broader aspects and, therefore, the appended claims are to encompass within their scope all such changes and modifications as are within the true spirit and scope of this invention. Furthermore, it is to be understood that the invention is solely defined by the appended claims. It will be understood by those within the art that if a specific number of an introduced claim element is intended, such an intent will be explicitly recited in the claim, and in the absence of such recitation no such limitation is present. For example, as an aid to understanding, the following appended claims may contain usage of the phrases "at least one" or "one or more," or the indefinite articles "a" or "an," to introduce claim elements. However, the use of such phrases should not be construed to imply that the introduction of a claim element by the indefinite articles "a" or "an" limits any particular claim containing such introduced claim element to inventions containing only one such element, even when the same claim includes the introductory phrases "one or more" or "at least one" and indefinite articles such as "a" or "an"; the same holds true for the use of definite articles used to introduce claim elements.

What is claimed is:

1. A computer system, comprising:

a processor;

a memory operably coupled to the processor; and an alignment mechanism including:

a x-axis direction contiguous-reference alignment mechanism including: at least one aft-positioned data processing system connection guidance cylinder slot; and a y-axis direction contiguous-reference alignment mechanism including:

at least one fore-positioned data processing system connection guidance cylinder slot formed to catch a connection guidance cylinder misaligned in the y-axis direction and guide the connection guidance cylinder into substantial y-axis direction alignment, wherein said guidance cylinder and guidance cylinder slot allows rotation during installation of a replacement component, wherein said rotation facilitates alignment of the replacement component in the y-axis direction.

2. The computer system as recited in claim 1, wherein the alignment mechanism further comprises:

a z-axis direction contiguous-reference alignment mechanism.

3. The computer system as recited in claim 1, wherein the alignment mechanism further comprises:

a base plate.

4. The computer system as recited in claim 3, wherein the alignment mechanism further comprises:

at least one electrical connector aligned relative to said base plate.

5. The computer system as recited in claim 4, further comprising:

at least one hook extruded from said base plate.

6. The computer system as recited in claim 4, further comprising:

a stud pressed fit into said base plate.

7. The computer system as recited in claim 4, wherein said base plate further comprises:

at least one mating electrical connector affixed to a power supply.

8. The computer system as recited in claim 1, wherein said at least one fore-positioned data processing system connection guidance cylinder slot further comprises:

said at least one fore-positioned data processing system connection guidance cylinder slot integral with a data processing system component.

9. The computer system as recited in claim 1, wherein said y-axis direction contiguous-reference alignment mechanism further comprises:

at least one fore-positioned data processing system connection guidance cylinder.

10. The computer system as recited in claim 9, wherein said at least one fore-positioned data processing system connection guidance cylinder further comprises:

said at least one fore-positioned data processing system connection guidance cylinder integral with at least one data processing system component receptacle.

11. The computer system as recited in claim 1, wherein said at least one aft-positioned data processing system connection guidance cylinder slot further comprises:

said at least one aft-positioned data processing system connection guidance cylinder slot integral with at least one data processing system component receptacle.

12. The computer system as recited in claim 1, wherein said x-axis direction contiguous-reference alignment mechanism further comprises:

at least one aft-positioned data processing system connection guidance cylinder.

13. The computer system as recited in claim 12, wherein said at least one aft-positioned data processing system connection guidance cylinder further comprises:

said at least one aft-positioned data processing system connection guidance cylinder integral with a data processing system component.

14. The computer system as recited in claim 1, further comprising:

a power supply connection.

15. The computer system as recited in claim 1, further comprising:

a hard drive connection.

16. The computer system as recited in claim 1, further comprising:

a CD-ROM connection.

17. An alignment mechanism, comprising:

a x-axis direction contiguous-reference alignment mechanism including at least one aft-positioned data processing system connection guidance cylinder slot; and a y-axis direction contiguous-reference alignment mechanism including at least one fore-positioned data processing system connection guidance cylinder slot formed to catch a connection guidance cylinder misaligned in the y-axis direction and guide the connection guidance cylinder into substantial y-axis direction alignment, wherein said guidance cylinder and guidance cylinder slot allow rotation during installation of a replacement component, wherein said rotation facilitates alignment of the replacement component in the y-axis direction.

18. The alignment mechanism as recited in claim 17, further comprising:

a z-axis direction contiguous-reference alignment mechanism.

19. The alignment mechanism as recited in claim 18, further comprising:

a base plate.

20. The alignment mechanism as recited in claim 19, further comprising:

at least one electrical connector aligned relative to said base plate.

21. The alignment mechanism as recited in claim 19, further comprising:

at least one hook extruded from said base plate.

22. The alignment mechanism as recited in claim 19, further comprising:

a stud pressed fit into said base plate.

23. The alignment mechanism as recited in claim 17, further comprising:

at least one mating electrical connector affixed to a power supply.

24. The alignment mechanism as recited in claim 17, wherein said at least one fore-positioned data processing system connection guidance cylinder slot further comprises:

said at least one fore-positioned data processing system connection guidance cylinder slot integral with a data processing system component.

25. The alignment mechanism as recited in claim 17, wherein said y-axis direction contiguous-reference alignment mechanism further comprises:

at least one fore-positioned data processing system connection guidance cylinder.

26. The alignment mechanism as recited in claim 25, wherein said at least one fore-positioned data processing system connection guidance cylinder further comprises:

said at least one fore-positioned data processing system connection guidance cylinder integral with at least one data processing system component receptacle.

27. The alignment mechanism as recited in claim 17, wherein said at least one aft-positioned data processing system connection guidance cylinder slot further comprises:

said at least one aft-positioned data processing system connection guidance cylinder slot integral with at least one data processing system component receptacle.

28. The alignment mechanism as recited in claim 17, wherein said x-axis direction contiguous-reference alignment mechanism further comprises:

at least one aft-positioned data processing system connection guidance cylinder.

29. The alignment mechanism as recited in claim 28, wherein said at least one aft-positioned data processing system connection guidance cylinder further comprises:

said at least one aft-positioned data processing system connection guidance cylinder integral with a data processing system component.

30. The alignment mechanism as recited in claim 17, further comprising:

a power supply connection.

31. The alignment mechanism as recited in claim 17, further comprising:

a hard drive connection.

32. The alignment mechanism as recited in claim 17, further comprising:

a CD-ROM connection.

33. A method of aligning a data processing system connection relative to a contiguous-reference structure, said method comprising:

aligning a data processing system connection relative to a contiguous-reference structure, wherein said aligning a data processing system connection relative to a contiguous-reference structure further includes:

aligning the data processing system connection in a x-axis direction relative to the contiguous-reference structure, further including:

aligning the data processing system connection utilizing at least one aft-positioned data processing system connection guidance cylinder slot; and aligning the data processing system connection in a y-axis direction relative to the contiguous-reference structure, wherein said aligning the data processing system connection in a y-axis direction relative to the contiguous-reference structure further includes:

aligning the data processing system connection via at least one fore-positioned data processing system connection guidance cylinder slot formed to catch a connection guidance cylinder misaligned in the y-axis direction and guide the connection guidance cylinder into substantial y-axis direction alignment, wherein said guidance cylinder and guidance cylinder slot allow rotation during installation of a replacement component, wherein said rotation facilitates alignment of the replacement component in the y-axis direction.

34. The method of claim 33, wherein said aligning a data processing system connection relative to a contiguous-reference structure further comprises:

aligning the data processing system connection in a z-axis direction relative to the contiguous-reference structure.

35. The method of claim 34, wherein said aligning the data processing system connection in a z-axis direction relative to the contiguous-reference stricture further comprises:

aligning at least one electrical connector relative to a base plate.

36. The method of claim 35, further comprising:

affixing at least one mating electrical connector to a data processing system component.

37. The method of claim 33, wherein said aligning the data processing system connection in a y-axis direction relative to the contiguous-reference structure further comprises:

aligning a data processing system connection via at least one fore-positioned data processing system connection guidance cylinder.

38. The method of claim 33, wherein said aligning a data processing system connection relative to a contiguous-reference structure further comprises:

aligning a power supply connection.

39. The method of claim 33, wherein said aligning a data processing system connection relative to a contiguous-reference structure further comprises:

aligning a hard drive connection.

40. The method of claim 33, wherein said aligning a data processing system connection relative to a contiguous-reference structure further comprises:

aligning a CD-ROM connection.

* * * * *